US010744542B2

(12) United States Patent
Bigney

(10) Patent No.: US 10,744,542 B2
(45) Date of Patent: Aug. 18, 2020

(54) POLISHING CHAMBER ASSEMBLY

(71) Applicant: Trinity River Technologies, LLC, Dayton, TX (US)

(72) Inventor: Nicholas D. Bigney, Dayton, TX (US)

(73) Assignee: Trinity River Technologies, LLC, Dayton, TX (US)

( * ) Notice: Subject to any disclaimer, the term of this patent is extended or adjusted under 35 U.S.C. 154(b) by 238 days.

(21) Appl. No.: 16/117,463

(22) Filed: Aug. 30, 2018

(65) Prior Publication Data

US 2019/0076891 A1 Mar. 14, 2019

Related U.S. Application Data

(60) Provisional application No. 62/556,742, filed on Sep. 11, 2017.

(51) Int. Cl.

| | |
|---|---|
| ***B08B 7/04*** | (2006.01) |
| ***B07B 4/08*** | (2006.01) |
| ***B08B 7/02*** | (2006.01) |
| ***B08B 5/02*** | (2006.01) |
| ***B07B 1/20*** | (2006.01) |
| ***B08B 5/04*** | (2006.01) |
| ***B08B 1/00*** | (2006.01) |
| ***B08B 1/02*** | (2006.01) |

(52) U.S. Cl.

CPC ..... *B08B 7/04* (2013.01); *B07B 1/20* (2013.01); *B07B 4/08* (2013.01); *B08B 5/023* (2013.01); *B08B 5/043* (2013.01); *B08B 7/02* (2013.01); *B08B 1/002* (2013.01); *B08B 1/02* (2013.01)

(58) Field of Classification Search

CPC .. B08B 7/04; B08B 5/043; B08B 7/02; B08B 5/023; B08B 1/002; B08B 1/02; B07B 1/20; B07B 4/08

See application file for complete search history.

(56) References Cited

U.S. PATENT DOCUMENTS 4,058,868 A * 11/1977 Champion ..... B08B 7/04 15/4
4,202,759 A * 5/1980 Krolopp ..... B04B 5/12 209/234

(Continued)

FOREIGN PATENT DOCUMENTS

CN 205799182 * 12/2016

*Primary Examiner* — David Redding
(74) *Attorney, Agent, or Firm* — Kunzler Bean & Adamson; Bruce R. Needham

(57) ABSTRACT

An apparatus, system, and method are disclosed for a polishing chamber assembly. An apparatus includes an inner drum positioned on a first axis and forming an inner chamber interior to the inner drum. The inner drum includes an object intake coupled to the inner drum at a proximal end of the inner drum and an object outlet disposed at a distal end of the inner drum. The apparatus includes an agitator configured to polish objects within the inner drum as the objects move from the object intake to the object outlet. The agitator is disposed within the inner drum and is removably coupled to a rotation element disposed on an end of the inner drum. The apparatus includes an outer drum disposed around the inner drum, which is removably coupled to the outer drum. The outer drum is releasably couplable to a base unit using attachment means.

20 Claims, 6 Drawing Sheets

(56) References Cited

U.S. PATENT DOCUMENTS

| | | | | |
|---|---|---|---|---|
| 7,735,415 | B2 * | 6/2010 | Zittel | B01D 29/58<br>99/348 |
| 2007/0044666 | A1 * | 3/2007 | Zittel | A23N 12/04<br>99/348 |

* cited by examiner

POLISHING CHAMBER ASSEMBLY

CROSS-REFERENCES TO RELATED APPLICATIONS

This application claims the benefit of U.S. Provisional Patent Application No. 62/556,742 entitled "CAPSULE POLISHER" and filed on Sep. 11, 2018, for Nicholas Daniel Bigney, which is incorporated herein by reference.

FIELD

The present disclosure relates to an object polisher and more particularly to polisher for cleaning and polishing capsules.

BACKGROUND

When capsules are filled with finely divided materials, e.g., powdered pharmaceutical or nutraceutical compounds, the capsules typically become covered with dust. It is desirable to remove the dust before the capsules are packaged for sale. The dust may be removed from the outside of the capsules by any means that does not damage an unacceptable portion of the capsules. It is common, for example, to remove dust from the capsules using some type of dust-removing mechanism, such as a felt liner, an electrostatic screen, or grains of a substance that removes the dust without itself sticking to the capsules, such as salt.

SUMMARY

An apparatus, system, and method are disclosed for a polishing chamber assembly. In one embodiment, an apparatus includes an inner drum positioned on a first axis and forming an inner chamber interior to the inner drum. The inner drum may include an object intake coupled to the inner drum at a proximal end of the inner drum and an object outlet disposed at a distal end of the inner drum. The apparatus, in certain embodiments includes an agitator configured to polish objects within the inner drum as the objects move from the object intake to the object outlet. The agitator may be disposed within the inner drum on the first axis coaxially with the inner drum and is removably coupled to a rotation element disposed on an end of the inner drum. In further embodiments, the apparatus includes an outer drum disposed around the inner drum, which is removably coupled to the outer drum. The outer drum may be releasably couplable to a base unit using attachment means. The base unit may include the rotation element.

A system, in one embodiment, includes a base unit that includes a pair of elongated rods and a rotary drive that is coupled to the base unit. In certain embodiments, the system includes an apparatus that includes an inner drum positioned on a first axis and forming an inner chamber interior to the inner drum. The inner drum may include an object intake coupled to the inner drum at a proximal end of the inner drum and an object outlet disposed at a distal end of the inner drum. The apparatus, in certain embodiments includes an agitator configured to polish objects within the inner drum as the objects move from the object intake to the object outlet. The agitator may be disposed within the inner drum on the first axis coaxially with the inner drum and is removably coupled to a rotation element disposed on an end of the inner drum such that the agitator rotates in response to the rotation element being driven by the rotary drive. In further embodiments, the apparatus includes an outer drum disposed around the inner drum, which is removably coupled to the outer drum. The outer drum may be releasably couplable to a base unit using attachment means that correspond to the elongated rods. The base unit may include the rotation element.

A modular system to polish objects includes a base unit that includes a pair of elongated rods and a rotary drive that is coupled to the base unit. In certain embodiments, the modular system includes an apparatus that includes an inner drum positioned on a first axis and forming an inner chamber interior to the inner drum. The inner drum may include an object intake coupled to the inner drum at a proximal end of the inner drum and an object outlet disposed at a distal end of the inner drum. The apparatus, in certain embodiments includes an agitator configured to polish objects within the inner drum as the objects move from the object intake to the object outlet. The agitator may be disposed within the inner drum on the first axis coaxially with the inner drum and is removably coupled to a rotation element disposed on an end of the inner drum such that the agitator rotates in response to the rotation element being driven by the rotary drive. In further embodiments, the apparatus includes an outer drum disposed around the inner drum, which is removably coupled to the outer drum. The outer drum may be releasably couplable to a base unit using attachment means that correspond to the elongated rods. The base unit may include the rotation element.

In further embodiments, the modular system includes a vacuum device that is removably coupled to a gas outlet disposed on a distal end of the outer drum using a vacuum line. The vacuum may be configured to draw gas from the apparatus through the gas outlet. In some embodiments, the modular system includes a feed chute that is coupled to the base unit and selectively disposed above the object intake of the inner drum to direct objects into the inner drum. In certain embodiments, the modular system includes an external gas supply that is removably coupled to the base unit to provide pressurized gas to the apparatus.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1:
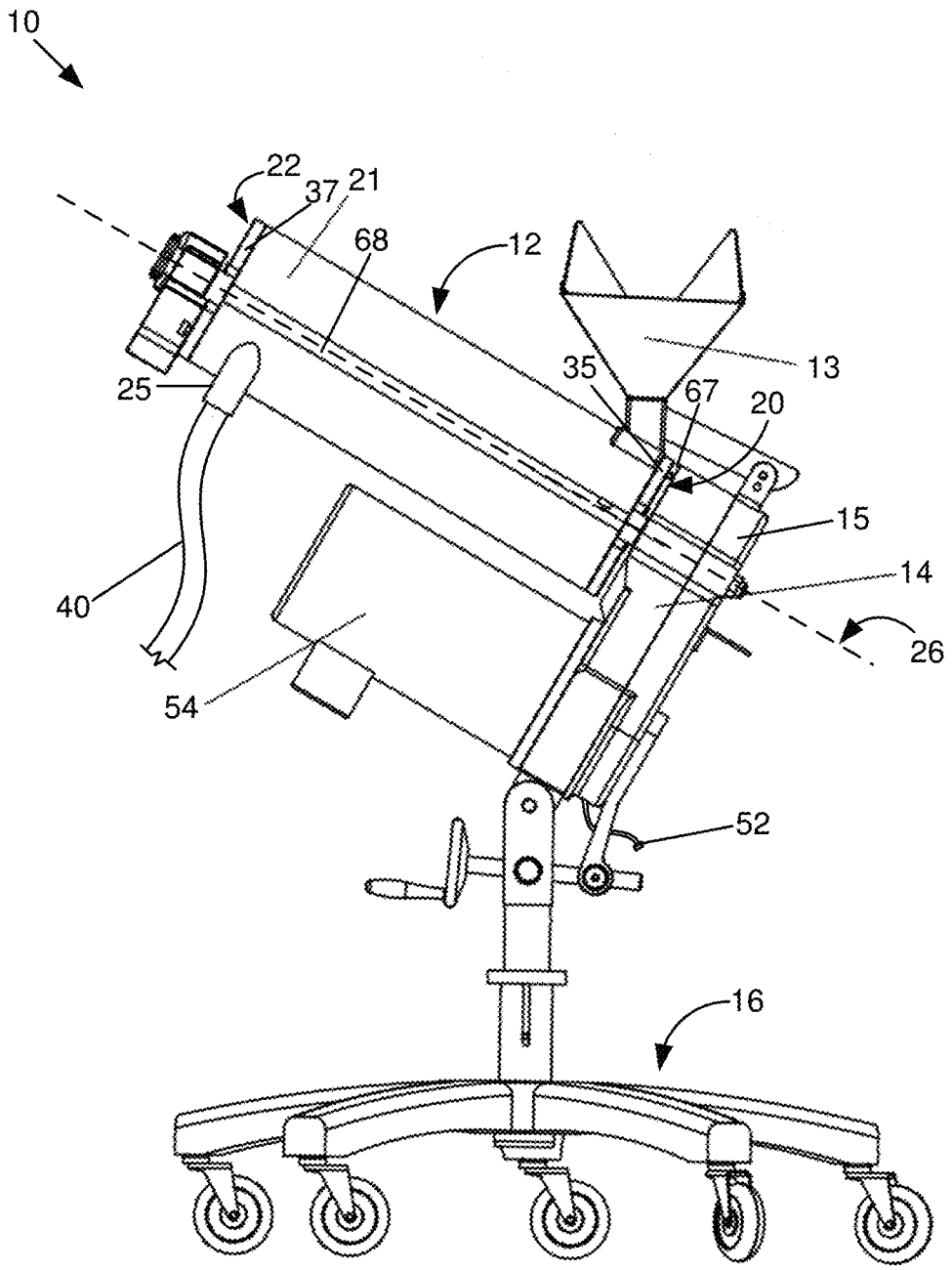
FIG. 1 depicts a side view of a capsule polisher consistent with at least one embodiment of the present disclosure.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

The present disclosure provides an apparatus and method for removing dust from the outside of filled capsules. The apparatus may comprise an inner drum including drum perforations therethrough and defining an inner chamber having proximal and distal ends, an input port for receiving capsules into the drum, an outlet for outputting polished capsules, and a longitudinal axis, the input port being closer than the outlet to the proximal end, an outer drum having proximal and distal ends and including a gas outlet, the outer drum receiving the inner drum therein so that an annular space is defined therebetween, the annular space being in fluid communication with the inner chamber by means of the drum perforations, a drive shaft for outputting rotational force, the drive shaft extending into the inner chamber, the drive shaft including a shaft gas passageway therethrough, a rotary drive mechanism comprising a power source, a motor for converting power to rotational force, and a fitting including a fitting gas passageway, the fitting being adapted to transfer the rotational force to the drive shaft when the drive shaft engages the fitting and the fitting gas passageway being adapted to fluidly communicate with the shaft gas passageway when the drive shaft engages the fitting, a brush including a body having body perforations therethrough and including capsule engaging means extending therefrom and configured to engage capsules in the inner chamber, the body perforations connecting the shaft gas passageway with the outside of the brush, the brush mounted on the drive shaft so as to rotate therewith; and a source of increased pressure gas connected to the fitting gas passageway, whereby a gas flow path is created that includes the fitting gas passageway, the shaft gas passageway, the brush body perforations, the drum perforations, the annular space, and the gas outlet, wherein the apparatus further includes a base and wherein the outer drum, inner drum, brush, and drive shaft form a polishing chamber assembly that is releasably supported on the base.

When the polishing chamber assembly is mounted on base, the distal ends of the inner and outer drums are higher than the proximal ends. The apparatus may further include a pair of end caps enclosing the proximal and distal ends, respectively, of the inner drum, and the end caps may be connected so as to retain the outer drum, inner drum, brush, and drive shaft and thereby form the polishing chamber assembly. In some embodiments, the apparatus includes a pair of rods extending between and connecting the end caps, the rods being connectable to the base so as to releasably retain the polishing chamber assembly on the base. When the polishing chamber assembly is mounted on base, an axial gap may be defined between the proximal end of the polishing chamber and the base. The axial gap may measure at least 0.10 inches (2.5 mm) in the axial direction.

The fitting may be adapted to allow a first portion of gas in the fitting gas passageway to escape from the fitting while allowing a second portion of gas in the fitting gas passageway to flow into the shaft gas passageway.

The airflow in the inner drum may include both a rotational flow component and a longitudinal flow component. The input port and the gas outlet may each have an axis that does not intersect the axis of the drive shaft and the gas outlet may be configured to tangentially receive gas flow having a rotational component initiated by the configuration of the input port.

The apparatus may further include a capsule-advancing device in the inner drum. The capsule-advancing device may be configured to cause capsules in the inner chamber to advance toward the distal end of the inner chamber when engaged by the capsule engaging means. The capsule-advancing device may comprise a coil disposed in the inner drum or may comprise at least one feature affixed to the inner surface of the inner drum.

The rotary drive mechanism may include a housing enclosing at least one component of the rotary drive mechanism and the inside of the housing may be at a positive pressure relative to the outside of the housing.

An apparatus, system, and method are disclosed for a polishing chamber assembly. In one embodiment, an apparatus includes an inner drum positioned on a first axis and forming an inner chamber interior to the inner drum. The inner drum may include an object intake coupled to the inner drum at a proximal end of the inner drum and an object outlet disposed at a distal end of the inner drum. The apparatus, in certain embodiments includes an agitator configured to polish objects within the inner drum as the objects move from the object intake to the object outlet. The agitator may be disposed within the inner drum on the first axis coaxially with the inner drum and is removably coupled to a rotation element disposed on an end of the inner drum. In further embodiments, the apparatus includes an outer drum disposed around the inner drum, which is removably coupled to the outer drum. The outer drum may be releasably couplable to a base unit using attachment means. The base unit may include the rotation element.

In one embodiment, the apparatus further includes a movement device that is disposed within the inner drum and configured to move the objects within the inner drum from the object intake to the object outlet while the agitator rotates. The movement device may be removably coupled to the inner drum. In some embodiments, the movement device includes a helical coil.

In further embodiments, the inner drum, outer drum, agitator and the helical coil are separable to facilitate cleaning. In various embodiments, the apparatus further includes a first end cap disposed on a proximal end of the outer drum and a second end cap disposed on a distal end of the outer drum. The first and second end caps may be removably coupled to the outer drum and configured to create a dust-proof seal within the outer drum.

In one embodiment, the inner drum, the outer drum, the agitator, the first end cap and the second end cap form a replaceable polisher drum assembly replaceable as a unit with another replaceable polisher drum assembly. In some embodiments, the rotation element includes a shaft that is selectively disposed on the first axis coaxially with the inner drum and extending within the inner chamber from the object intake to the object outlet. The agitator may be configured to selectively receive the shaft such that the agitator rotates with the shaft.

In further embodiments, the agitator includes a brush. The brush may include a plurality of bristles disposed along a length of the brush. In certain embodiments, the inner drum and the outer drum are substantially cylindrical such that there are no corners where debris can accumulate within the apparatus. In various embodiments, the outer drum includes a gas outlet configured for drawing gas from the apparatus. The gas outlet may be disposed tangential to the outer drum and axially opposite of the object intake. The object intake may be disposed tangentially to the inner drum.

In one embodiment, a cyclonic gas flow is generated within the apparatus from the object intake to the gas outlet in response to drawing gas from the apparatus through the gas outlet. In further embodiments, the agitator is configured to rotate in a rotational direction of the cyclonic flow to increase the cyclonic effect of the cyclonic gas flow.

A system, in one embodiment, includes a base unit that includes a pair of elongated rods and a rotary drive that is coupled to the base unit. In certain embodiments, the system includes an apparatus that includes an inner drum positioned on a first axis and forming an inner chamber interior to the inner drum. The inner drum may include an object intake coupled to the inner drum at a proximal end of the inner drum and an object outlet disposed at a distal end of the inner drum. The apparatus, in certain embodiments includes an agitator configured to polish objects within the inner drum as the objects move from the object intake to the object outlet. The agitator may be disposed within the inner drum on the first axis coaxially with the inner drum and is removably coupled to a rotation element disposed on an end of the inner drum such that the agitator rotates in response to the rotation element being driven by the rotary drive. In further embodiments, the apparatus includes an outer drum disposed around the inner drum, which is removably coupled to the outer drum. The outer drum may be releasably couplable to a base unit using attachment means that correspond to the elongated rods. The base unit may include the rotation element.

In one embodiment, the system further includes a movement device that is disposed within the inner drum and configured to move the objects within the inner drum from the object intake to the object outlet while the agitator rotates. The movement device may be removably coupled to the inner drum. In some embodiments, the movement device is a helical coil.

In certain embodiments, the inner drum, outer drum, agitator and the helical coil are separable to facilitate cleaning. In various embodiments, the system further includes a first end cap disposed on a proximal end of the outer drum and a second end cap disposed on a distal end of the outer drum. The first and second end caps may be removably coupled to the outer drum and configured to create a dust-proof seal within the outer drum.

In one embodiment, the inner drum, the outer drum, the agitator, the first end cap and the second end cap form a replaceable polisher drum assembly replaceable as a unit with another replaceable polisher drum assembly. In various embodiments, the rotation element is a shaft that is selectively disposed on the first axis coaxially with the inner drum and extending within the inner chamber from the object intake to the object outlet. The agitator may be configured to selectively receive the shaft such that the agitator rotates with the shaft. In some embodiments, the inner drum and the outer drum are substantially cylindrical such that there are no corners where debris can accumulate within the apparatus.

A modular system to polish objects includes a base unit that includes a pair of elongated rods and a rotary drive that is coupled to the base unit. In certain embodiments, the modular system includes an apparatus that includes an inner drum positioned on a first axis and forming an inner chamber interior to the inner drum. The inner drum may include an object intake coupled to the inner drum at a proximal end of the inner drum and an object outlet disposed at a distal end of the inner drum. The apparatus, in certain embodiments includes an agitator configured to polish objects within the inner drum as the objects move from the object intake to the object outlet. The agitator may be disposed within the inner drum on the first axis coaxially with the inner drum and is removably coupled to a rotation element disposed on an end of the inner drum such that the agitator rotates in response to the rotation element being driven by the rotary drive. In further embodiments, the apparatus includes an outer drum disposed around the inner drum, which is removably coupled to the outer drum. The outer drum may be releasably couplable to a base unit using attachment means that correspond to the elongated rods. The base unit may include the rotation element.

In further embodiments, the modular system includes a vacuum device that is removably coupled to a gas outlet disposed on a distal end of the outer drum using a vacuum line. The vacuum may be configured to draw gas from the apparatus through the gas outlet. In some embodiments, the modular system includes a feed chute that is coupled to the base unit and selectively disposed above the object intake of the inner drum to direct objects into the inner drum. In certain embodiments, the modular system includes an external gas supply that is removably coupled to the base unit to provide pressurized gas to the apparatus.

Figure 2:
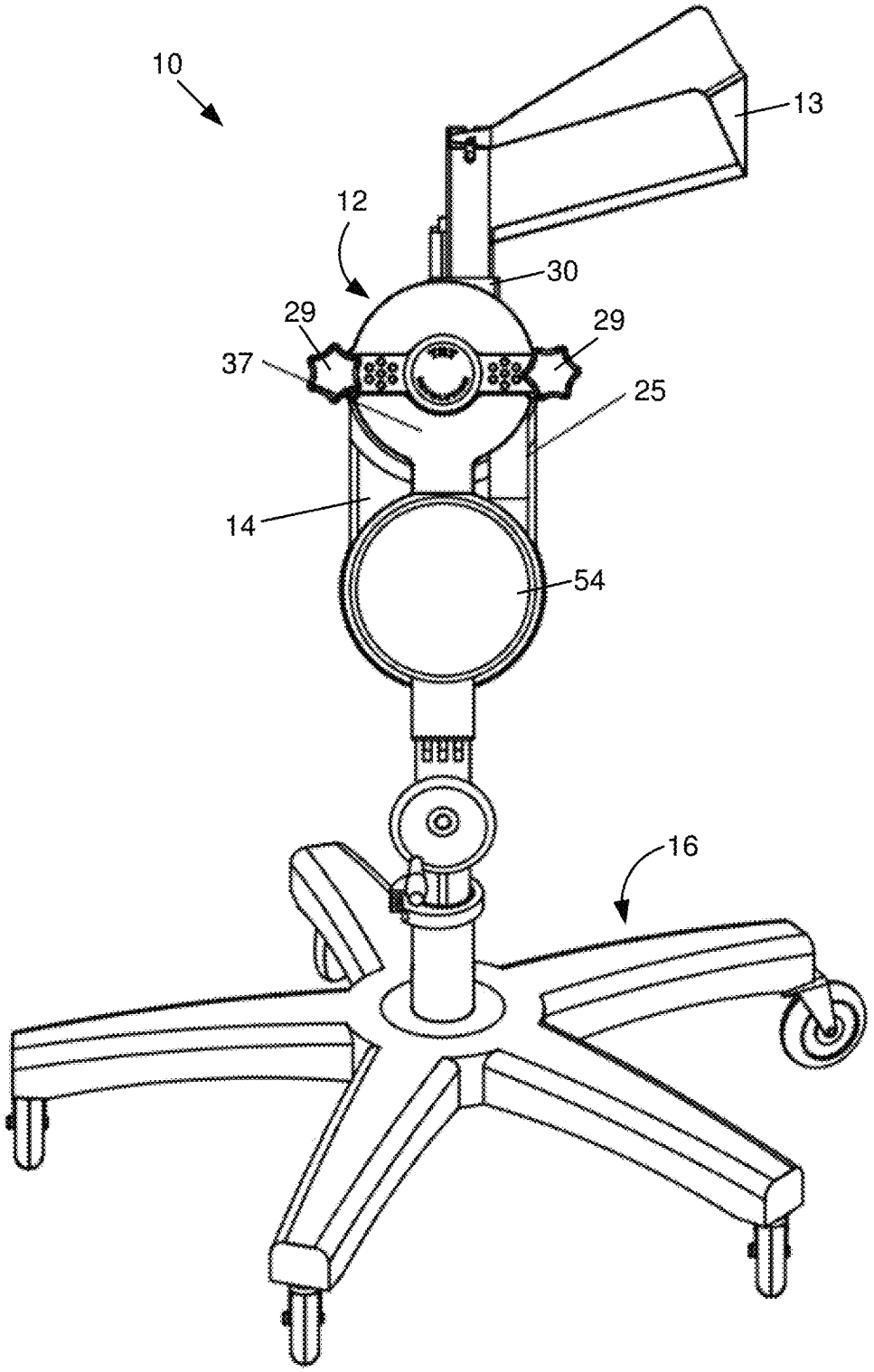
FIG. 2 depicts an end view of the capsule polisher of FIG. 1.

FIGS. 1-2 depict an apparatus 10 for polishing filled capsules. A polisher 10 may include a polishing chamber assembly 12, a rotary drive mechanism 14, and a base 16. The form of the base 16 may include various forms and characteristics such as different heights, adjustability, pivotability, rollability, and the like. Similarly, the rotary drive mechanism 14 may take any desired form so long as it can generate a rotational force. Polishing chamber assembly 12 may have a proximal end 20, a distal end 22, and a longitudinal axis 26.

Figure 4:
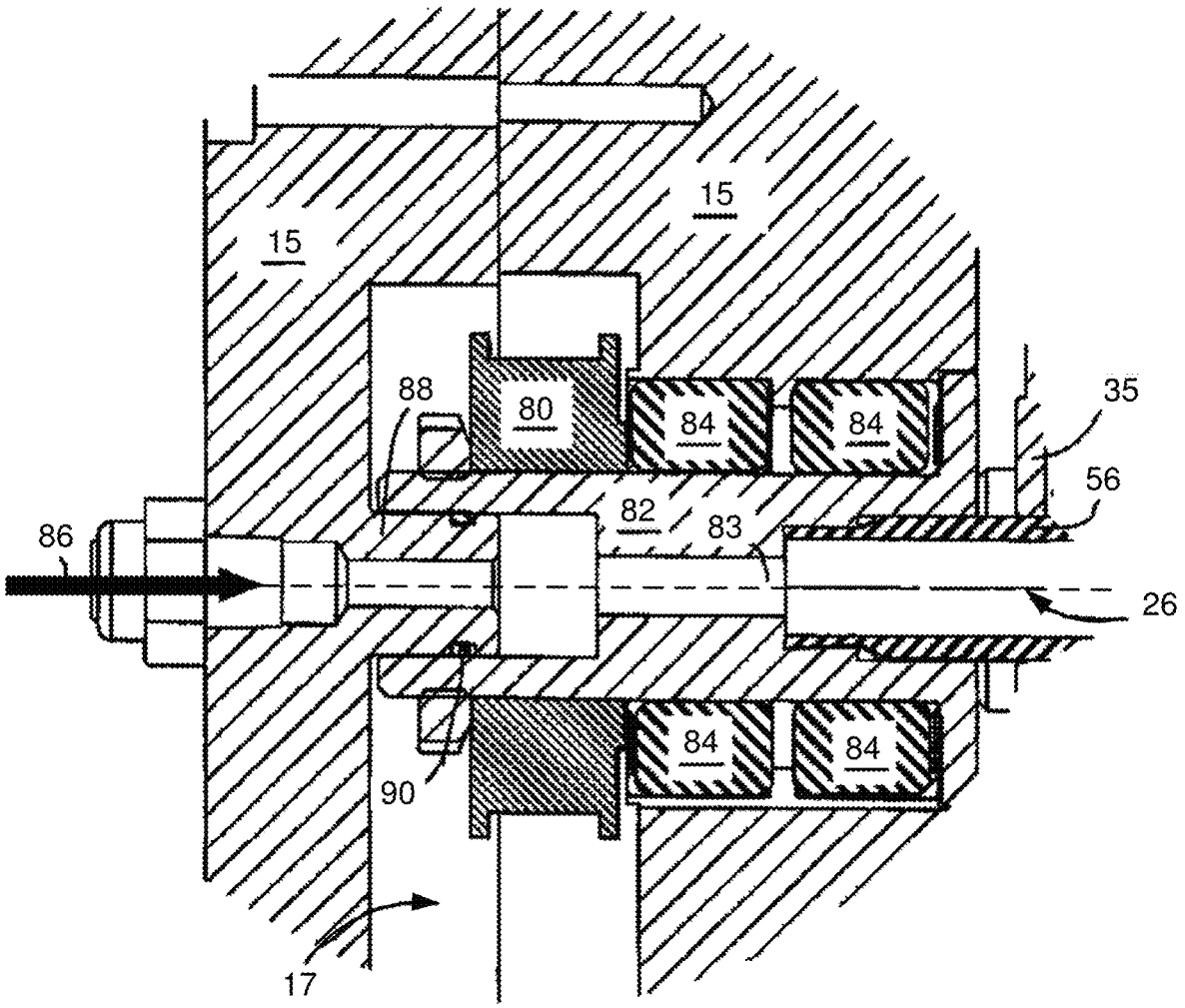
FIG. 4 is an enlarged partial cross-section of a portion of a polishing chamber assembly consistent with at least one embodiment of the present disclosure.

Referring to FIGS. 1-2 and 4, the rotary drive mechanism 14 may include a power source 52, a motor 54 for converting power to rotational force, and a fitting (FIG. 4) for transferring the rotational force from the motor 54 to the polishing chamber assembly 12. In some embodiments, the rotary drive mechanism 14 may include a housing 15 that has an interior 17 that may enclose at least a portion of the rotary drive mechanism 14. In certain embodiments, the rotational axis of the fitting, which may coincide with the longitudinal axis 26 of the polishing chamber assembly 12, may be different from the rotational axis of the motor 54, in which case the rotor may be connected to the motor 54 by a belt or other suitable force-transmitting means such as are known in the art. As shown by the arrow 86 in FIG. 4, pressurized gas may be fed into the apparatus 10 via a gas feed 88, which may be part of the main body of the drive unit. In FIG. 4, the belt drive pulley 80 rotates a drive axle 82, which has a central bore 83. The drive axle 82 may be supported by a plurality of contact bearings 84 and may engage the gas feed 88 so as to allow the flow of gas therefrom into the central bore 83.

Still referring to FIG. 4, at least one O-ring 90 or other sealing device may be provided between the drive axle 82 and the gas feed 88. The O-ring 90 may be configured to form an imperfect seal between the drive axle 82 and the gas feed 88. As a result, on the way to the bore 83, a portion of the pressurized gas entering via the gas feed 88 may be allowed to escape into the interior 17 of the housing 15. In this manner, an additional gas flow path may be created such that a portion of the pressurized gas is used to create positive pressure in the interior 17 of the housing 15. The positive pressure causes gas flow away from the rotary drive mechanism 14 and away from at least one of the power source 52, the motor 54, and the drive shaft 56. This gas flow reduces the risk that particulate matter will accumulate on the drive components that may include the belt, the pulley 80, and the bearings 84. A similar construction may be in place at the distal end 22 such that a portion of the pressurized gas may be used to create a positive pressure environment within the assembly components surrounding the distal end of the shaft 56.

Figure 3:
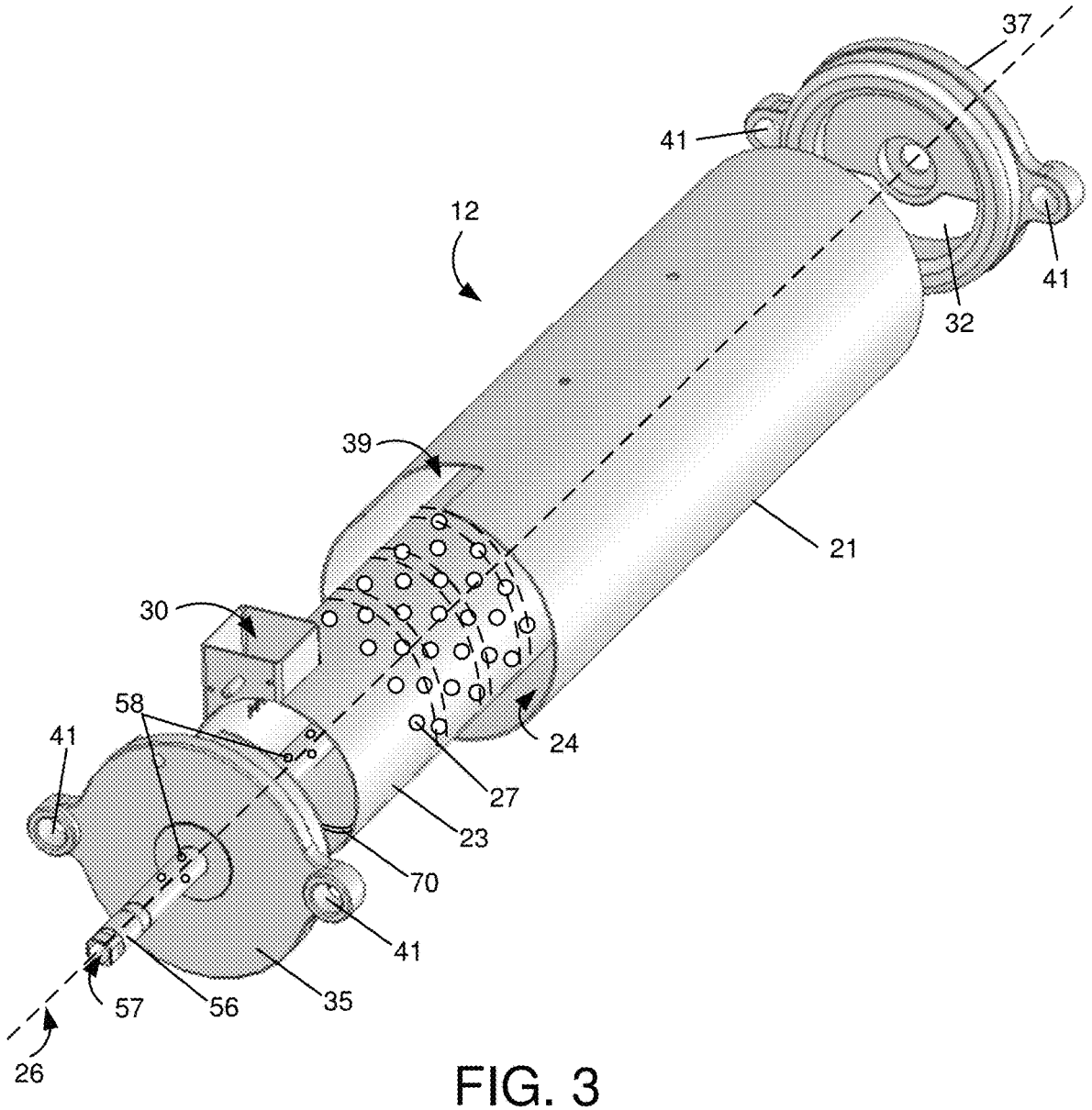
FIG. 3 is a partially exploded view of a polishing chamber assembly consistent with at least one embodiment of the present disclosure.
Figure 5:
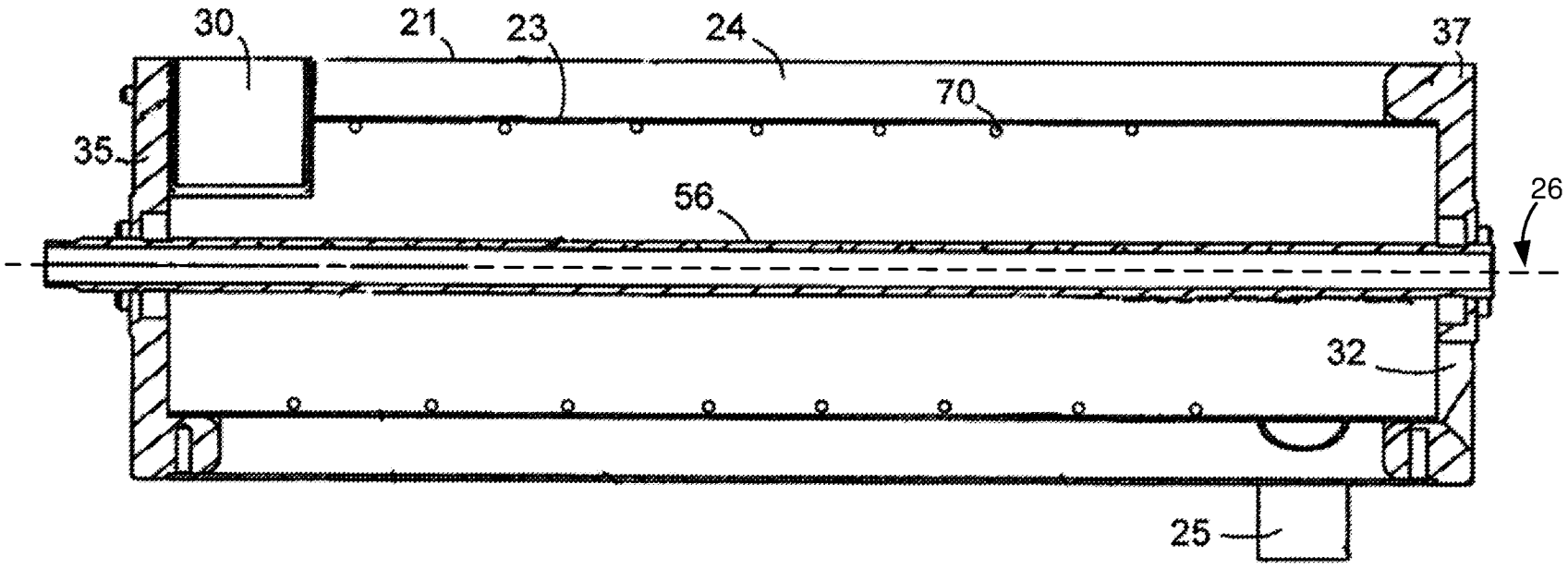
FIG. 5 is a cross-section of a polishing chamber assembly consistent with at least one embodiment of the present disclosure.

Referring to FIGS. 3 and 5, the polishing chamber assembly 12 includes an outer drum 21, an inner drum 23, a central drive shaft 56, a proximal end cap 35, and a distal end cap 37. An annular space 24 may be defined between the inner drum 23 and the outer drum 21. The inner drum 23 may include an object intake or input port 30 for receiving objects such as capsules into the inner drum 23. In one embodiment, the input port 30 is disposed tangential to the inner drum 23 at a proximal end of the inner drum 23. The inner drum 23 may further include an object outlet 32 for outputting polished objects, e.g., polished capsules, disposed on a distal end of the inner drum 23. The inner drum 23 may include perforations 27 through the drum wall, which allow gas to flow from the inside of the inner drum 23 into the annular space/chamber 24 between the inner drum 23 and the outer drum 21. It will be understood that only a portion of the perforations 27 are illustrated. The perforations 27 may occupy all or any amount of the surface of the inner drum 23.

The outer drum 21, in one embodiment, is disposed around and encloses the inner drum 23. In such an embodiment, the annular space 24 is formed interior to the outer drum 21 and exterior to the inner drum 23. In one embodiment, the outer drum 21 includes a gas outlet 25 near the distal end 22 of the polishing chamber assembly 12. The gas outlet, in one embodiment, is disposed or positioned longitudinally and axially opposite of the input port 30, which is disposed tangential to the inner drum 23 at a proximal end of the inner drum 23. In various embodiments, a vacuum line 40, illustrated in FIG. 1, may be in fluid communication with the gas outlet 25, e.g., the vacuum line 40 may be releasably coupled to the gas outlet 25 to draw gases, e.g., air, from the polishing chamber assembly 12, including the annular space 24. In various embodiments, the outer drum is releasably coupled to the base 16 and/or housing 15, which includes a rotation element, described below, for actuating an agitator disposed inside the inner drum 23.

In one embodiment, the outer drum 21 includes a cut-out 39 to accommodate the input port 30. The input port 30 may be substantially adjacent to the proximal end 20 of the polishing chamber assembly 12 and may support an optional, removable feed chute 13, as illustrated in FIG. 1, for feeding objects such as capsules into the inner drum 23. The object outlet 32 may include an opening in the distal end cap 37. In some embodiments, both the input port 30 and the object outlet 32 are openings through which objects such as capsules can fall by gravity. In some embodiments one or both of the input port 30 and the object outlet 32 may include one or more gates and/or screens (not shown) to direct, control, and/or filter a stream of objects.

In one embodiment, the proximal end cap 35 and the distal end cap 37 are disposed on the proximal and distal ends, respectively, of the outer drum 21. The proximal end cap 35 and the distal end cap 37 may be configured to form air-tight, dust-proof seals at the proximal and distal ends of the outer drum 21 so that dust, gases, and/or other debris does not escape the polishing chamber assembly 12 while in use. The proximal end cap 35 and the distal end cap 37, in one embodiment, are removably coupled to the outer drum 21 so that the end caps 35, 37 can be removed to facilitate access to the inside of the polishing chamber assembly 12, to facilitate removal of the other components, e.g., the inner drum 23, the brush 60, the coil 70, and/or the like, and to facilitate cleaning of the polishing chamber assembly 12. In one embodiment, the inner drum 23 and the outer drum 21 are substantially cylindrical so that there are no corners where debris can accumulate within the polishing chamber assembly 12, which allows for extended use and quick and easy cleanup of the polishing chamber assembly 12.

Figure 6:
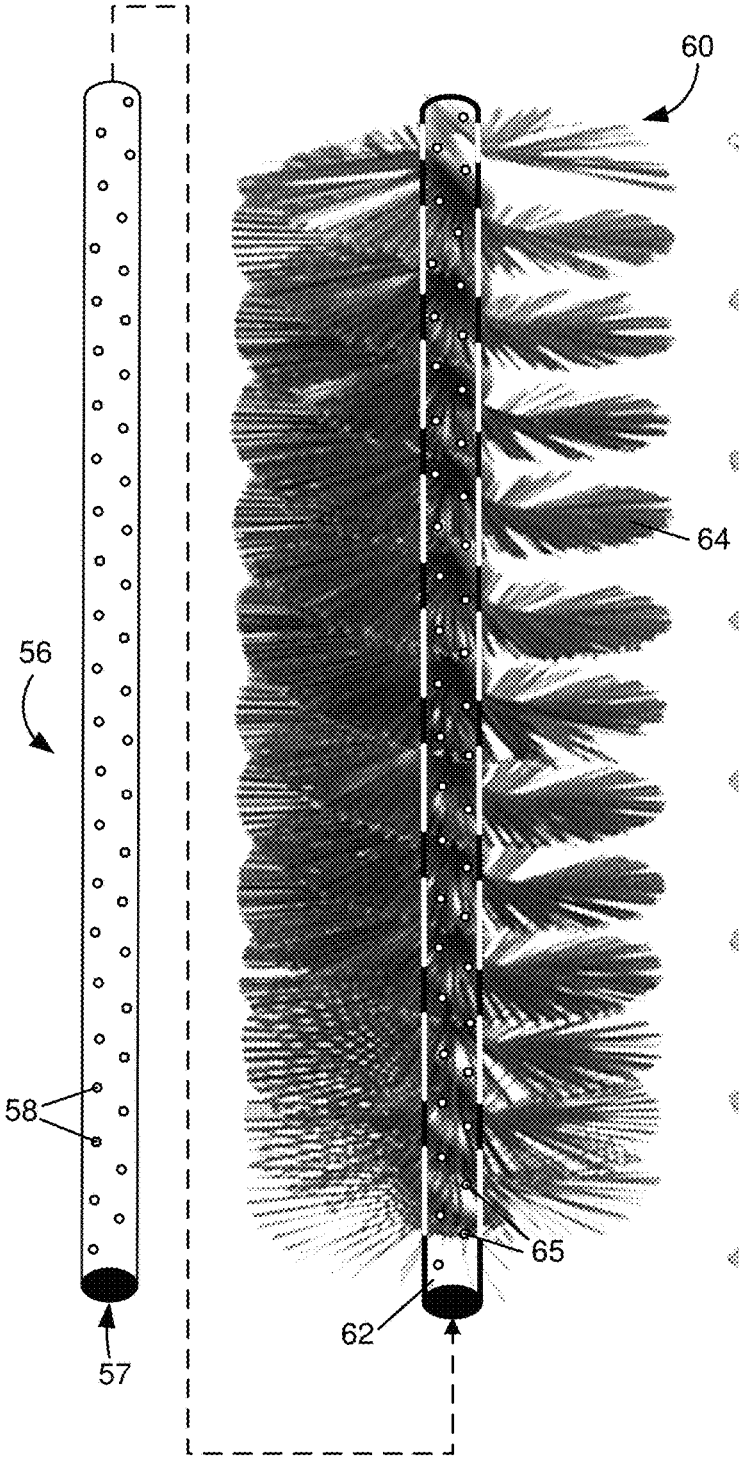
FIG. 6 is an exploded view of a drive shaft and agitator consistent with at least one embodiment of the present disclosure.

As illustrated in FIG. 3 and FIG. 6, the drive shaft 56 may include a hollow tube having a central bore 57 and perforations 58 through the shaft wall. The bore 57 and perforations 58 define a shaft gas passageway that provides fluid communication between the stationary gas feed and the outside of the shaft 56. In some embodiments, the shaft perforations 58 may be 0.078 inches (1.98 mm) in diameter and may be provided in two rows of about 15 perforations each, spaced about 1 inch (25 mm) apart.

Referring to FIG. 6, an agitator, e.g., a brush 60 (which is used herein throughout for convenience) may be removably coupled to a rotation element such as a drive shaft 56, a rotatable joint that couples to a proximal end of the brush 60, and/or the like between the end caps 35, 37 so as to be disposed within the inner drum 23 along the longitudinal axis 26 when the polishing chamber assembly 12 is assembled. In such an embodiment, when the rotary drive mechanism 14 is activated, it causes the rotation element and the brush 60 to rotate. In one embodiment, the length of the brush 60 extends within the inner drum 23 from the input port 30 to the object outlet 32. The brush 60 may include a hollow body 62 sized to fit onto the shaft 56. The body 62 may mechanically engage the shaft 56 via a friction fit, a set screw, and/or other suitable engagement or fastening mechanism.

Agitation- and/or capsule-engaging means 64, e.g., bristles of the brush 60 may extend radially outward from the brush body 62. The capsule-engaging means 64 may include any device that is suitable for contacting capsules without damaging them, including without limitation bristles, filaments, fingers, spongy elements, fringe, and felted or enmeshed fibers. In some embodiments, the capsule-engaging means 64 may include a food-grade material, for example nylon filament wrapped around a core wire, which in turn is contained in a channel that is crimped around the wire and filaments. The channel may then be helically wrapped around a mandrel having an inside diameter that is slightly larger than the outside diameter of the shaft 56.

The brush body 62 may form a tube that includes a plurality of perforations 65 along the length of the brush body 62 so as to allow the passage of air, or other gas, from the inside to the outside of the brush 60. In operation, gas flowing into the bore 57 of the shaft 56 from an external gas supply exits through the shaft perforations 58 and the brush perforations 65 and flows outward through the capsule-engaging means 64. In certain embodiments, the brush body 62 may include one or more additional gas passageways to facilitate the flow of gas therethrough.

The polishing chamber assembly 12, which may include the outer and inner drums 21, 23 the proximal and distal end caps 35, 37 the shaft 56, and, optionally, the brush 60 may be held together by a pair of elongated rods 68, illustrated in FIG. 1, each rod 68 passing through a pair of aligned openings 41, illustrated in FIG. 3, in the end caps 35, 37 and releasably secured using fastening means, illustrated in FIG. 2, such as nuts. In one embodiment, the polishing chamber assembly 12 and/or its components may each be releasably connected using any suitable connection type including without limitation interference fit, bayonet, clamp or latch, full or partial threads, adhesive, elastic bands, and hook-and-loop connections. Likewise, polishing chamber assembly 12 may be releasably supported on the base 16 or the housing 15. In some embodiments, the polishing chamber assembly 12 is constructed such that an operator can remove it from the base 16 and/or the housing 15, either as an assembled unit or as separate components, without tools and, in some embodiments, using just one hand.

The proximal end of the drive shaft 56 may be directly or indirectly connected to the drive axle 82. When the rotary drive mechanism 14 is turned on, the drive axle 82 causes the drive shaft 56 and, optionally, the brush 60, to rotate within the inner drum 23.

Figure 7:
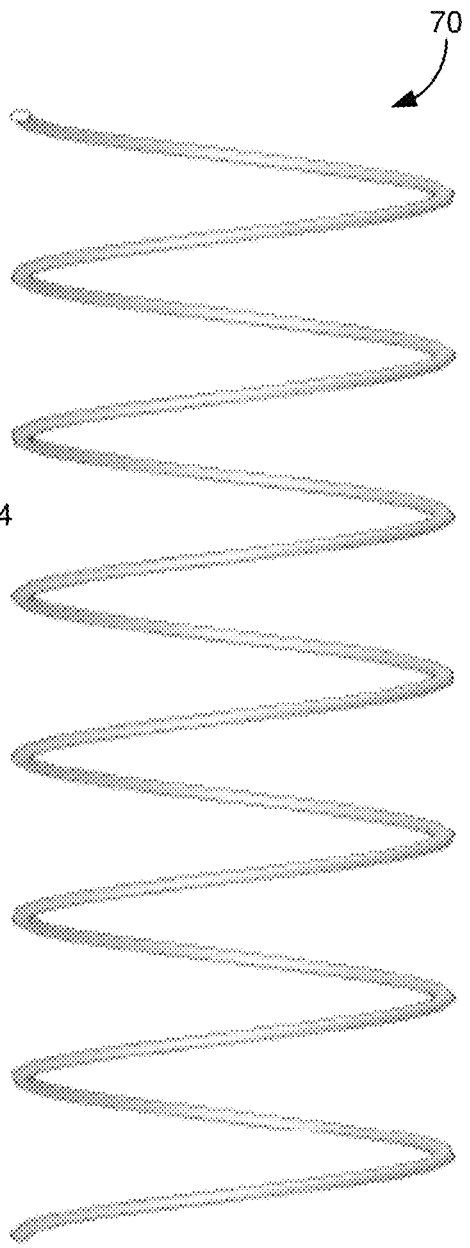
FIG. 7 is a view of a coil consistent with at least one embodiment of the present disclosure.

Referring again to FIGS. 3, 5, and 7, the polishing chamber assembly 12 may further include a movement device for advancing objects, e.g., capsules through the inner drum 23 as the brush 60 rotates, which is illustrated for purposes of discussion as a coil 70, depicted in FIG. 7, and shown partially in phantom in FIG. 3. The coil 70 rests inside the inner drum 23 and is configured such that when the brush 60 rotates, the capsule engaging means 64 causes capsules within the inner drum 23 to tumble and to be advanced through the inner drum 23 by the coil 70 toward the distal end 22 of the polishing chamber assembly 12. The capsule-engaging means 64 are preferably configured such that they sweep the inside surface of inner drum 23, thereby facilitating the tumbling action.

Polishing apparatus 10 may be constructed such that in normal operation the longitudinal axis 26 of polishing chamber assembly 12 is inclined and the distal end 22 is higher, e.g., farther from the ground, than the proximal end 20. In this embodiment, the coil 70 may be constructed such that as capsules in the polishing chamber assembly 12 are tumbled by engagement with the capsule-engaging means 64, they are advanced upward toward the distal end 22 of the polishing chamber assembly 12 by the coil 70.

It will be understood that the movement device can have a variety of configurations other than what is illustrated as coil 70. For example, the same function may be performed by raised features, such as baffles, ridges, or bosses disposed on the inside wall of the inner drum 23 or by a device that rotates with or separately from the brush 60.

As mentioned above with respect to the arrow 86 illustrated in FIG. 4, a source of pressurized gas may be in fluid communication with the inside of the shaft 56 by means of a fitting (not shown), such as a quick-connect fitting. The pressurized gas may include air or other gas. The pressure of the pressurized gas at the source may be above the ambient air pressure and, without limitation, may be at least five pounds per square inch ("psi") above the ambient air pressure, at least 10 psi above the ambient air pressure, or at least 60 psi above the ambient air pressure. In addition, a pump (not shown) may be in fluid communication with the gas outlet 25 via vacuum line 40. The pump may be a vacuum pump, which draws gas in the outer drum 21 toward gas outlet and the pump inlet.

In this manner, a gas flow path may be created such that when the polishing apparatus 10 is in operation, gas may flow from the gas source, through the gas feed 88, into the bore 57 of the shaft 56, out through the shaft perforations 58 and the capsule engaging means 64 of the brush 60. In the inner drum 23, gas from the external pressurized gas source joins, mixes, or combines with gas (e.g., air) in the inner drum 23 that entered with the capsules through input port 30. From the inner drum 23, the gas flows out through the perforations 27 in the wall of the inner drum 23, into the outer drum 21, through the gas outlet 25, and into the vacuum pump. Some of the gas may also exit the inner drum 23 with the capsules that exit the polisher apparatus 10 via the object outlet 32 at the distal end 22. In some embodiments, the volume of gas entering through the input port 30 is significantly greater than the volume of pressurized gas entering the inner drum 30 through the brush 60. In some embodiments, the volume of pressurized gas exiting through the gas outlet 25 is significantly greater than the volume of gas exiting the inner drum 23 through the capsule output 32.

In some embodiments, the arrangement of the input port 30 and the gas outlet 25 is such that airflow within the polishing chamber assembly 12 includes both a rotational flow component about the axis 26 and a longitudinal flow component from the proximal end 20 to the distal end 22.

In some embodiments, for example, the input port 30 and the gas outlet 25 may each occupy tangential positions on the polishing chamber assembly 12. Thus, for example, the input port 30 may be on the top left side of the polishing chamber assembly 12 and the gas outlet 25 may be on the bottom right side of the polishing chamber assembly 12 (as viewed along the longitudinal axis of the assembly 12 from the proximal end 20 of the assembly 12). In these embodiments, the axis of the input port 30 does not intersect the axis 26 of the assembly. Likewise, the axis of the gas outlet 25 does not intersect the axis 26 of the assembly.

Further, in these embodiments, both the input port 30 and the gas outlet 25 align with a general direction of gas flow at their respective positions. Specifically, gas entering at input port 30 will tend to begin rotating in a counterclockwise direction (as viewed from the proximal end 20 of the assembly 12). This rotation will generally continue as the gas moves along the axis of the polishing chamber assembly 12 and may be enhanced by the rotation of the brush 60 in the same direction. The gas outlet 25 may be tangentially aligned with the direction of gas flow at the location of the gas outlet 25 to allow the rotating gas to exit with minimum turbulence. Thus, in some embodiments, the gas outlet 25 is configured to tangentially receive a gas flow having a rotational component initiated by the configuration of the input port 30.

Thus, in one embodiment, a cyclonic gas flow is generated within the polishing chamber assembly 12 from the input port 30 to the gas outlet 25 in response to drawing, sucking, or otherwise removing gas from the polishing chamber assembly 12 through the gas outlet 25. In certain embodiments, the locations of the input port 30 and the gas outlet 25 relative to one another promotes the generation of the cyclonic gas flow within the polishing chamber assembly 12, in addition to the rotation of the brush 60 and coil 70, the mixture of gases within the polishing chamber assembly 12 with gases from an external gas supply, and the rate in which gases are removed from the polishing chamber assembly 12 through the gas outlet. In such an embodiment, the annular chamber 24 is positioned to receive debris removed from surfaces of objects within the inner drum 23 in a path of the cyclonic gas flow. The debris may be passed through the inner drum perforations 27, along the outer drum 21, and extracted from the polishing chamber assembly 12 through the gas outlet 25.

In one embodiment, as described above, gas from the exterior gas supply mixes with gases within the inner drum 23, which may increase the cyclonic effect of the cyclonic gas flow. Furthermore, in certain embodiments, the brush 60 is configured to rotate in a rotational direction of the cyclonic flow within the inner drum 23 to increase the cyclonic effect of the cyclonic air flow. In such an embodiment, the brush 60 is configured to rotate between approximately one-hundred rotations per minute and approximately eight-hundred rotations per minute. In one embodiment, the brush 60 is configured to rotate approximately four-hundred rotations per minute.

In certain embodiments, the volume of gas entering through the input port 30 may be significantly greater than the volume of pressurized gas entering the inner drum 23 through the brush 60 from the external gas supply, which may increase the cyclonic effect of the cyclonic gas flow. In further embodiments, the volume of gas exiting through the gas outlet 25 (e.g., being drawn from the polishing chamber assembly 12 using the vacuum pump) may be significantly greater than the volume of gas exiting the inner drum 23 through the object outlet 32, which may increase the cyclonic effect of the cyclonic gas flow.

Referring again to FIG. 1, the polisher 10 may be constructed such that there is a gap 67 between the proximal end 20 of the polishing chamber assembly 12 and the base 16 or rotary drive housing 15. In some embodiments, the gap 67 measures at least 0.10 inches (2.5 mm) in the axial direction and may measure at least 0.25 inches (6 mm) in the axial direction. In one embodiment, providing a gap 67 reduces the likelihood that dust from the capsules will enter the housing 15 or encounter the components of the rotary drive mechanism 14, which, in some embodiments, facilitates ease of cleaning the drive mechanism and creates a discrete polishing chamber assembly 12 that can be easily removed and replaced with the capsule polishing components in situ.

In various embodiments, the polishing chamber assembly 12 is modular such that the inner drum 23, outer drum 21, brush 60, and the helical coil 70 are separable components, e.g., each component is releasably or removably coupled together, which facilitates ease of cleaning the drive mechanism 14 and creates a discrete polishing chamber assembly 12 that can be easily removed and replaced with the capsule polishing components in situ. In other words, the inner drum 23, the outer drum 21, the brush 60, the proximal end cap 35, the second end cap 37, and the helical coil 70 form a replaceable polishing chamber assembly 12 that can be replaceable as a unit with another replaceable polishing chamber assembly 12.

Example Operation

In operation, for example, capsules may be fed into the polishing chamber assembly 12 via the input port 30. The capsules may fall against the inner side wall of the inner drum 23 near the proximal end 20, tumble toward the distal end 22 by the rotation action of the brush 60 and the coil 70, and exit the inner drum 23 via the object outlet 32. As the capsules tumble toward the outlet, their outer surfaces are cleaned by contact with each other, contact with the capsule engaging means 64 of the rotating brush 60, and the cyclonic flow of gas moving past them.

At the same time, gas, which may be air, flows from the external gas supply, through the gas feed 88, into the bore 57 of the rotating shaft 56, and out through the shaft perforations 58. The pressurized gas may then flow through the brush perforations 65, the capsule engaging means 64, between the capsules in the inner drum 23, out through the perforations 27 in the inner drum 23 and into the annular space 24. The gas may further flow from the annular space 24 through the gas outlet 25 and into the vacuum pump. Some gas may also exit the inner drum 23 with capsules that exit the polisher via the object outlet 32. While inside the inner drum 23 and the annular space 24, the gas mixes with gases within the inner drum 23 and rotates to generate a cyclonic gas flow as it traverses the length of the inner drum 23.

Gas leaving the polisher 10 may be filtered or otherwise treated to remove entrained particles. If various gas flow paths are provided, two or more flow paths may ultimately be manifolded together prior to removal of the entrained particles.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

an inner drum positioned on a first axis and forming an inner chamber interior to the inner drum, the inner drum comprising an object intake coupled to the inner drum at a proximal end of the inner drum and an object outlet disposed at a distal end of the inner drum;

an agitator configured to polish objects within the inner drum as the objects move from the object intake to the object outlet, the agitator disposed within the inner drum on the first axis coaxially with the inner drum, the agitator removably coupled to a rotation element disposed on an end of the inner drum; and an outer drum disposed around the inner drum, the inner drum removably coupled to the outer drum, the outer drum releasably couplable to a base unit using attachment means, the base unit comprising the rotation element.

2. The apparatus of claim 1, further comprising a movement device disposed within the inner drum and configured to move the objects within the inner drum from the object intake to the object outlet while the agitator rotates, the movement device removably coupled to the inner drum.

3. The apparatus of claim 2, wherein the movement device comprises a helical coil.

4. The apparatus of claim 3, wherein the inner drum, outer drum, agitator and the helical coil are separable to facilitate cleaning.

5. The apparatus of claim 1, further comprising a first end cap disposed on a proximal end of the outer drum and a second end cap disposed on a distal end of the outer drum, the first and second end caps removably coupled to the outer drum and configured to create a dust-proof seal within the outer drum.

6. The apparatus of claim 5, wherein the inner drum, the outer drum, the agitator, the first end cap and the second end cap form a replaceable polisher drum assembly replaceable as a unit with another replaceable polisher drum assembly.

7. The apparatus of claim 1, wherein the rotation element comprises a shaft that is selectively disposed on the first axis coaxially with the inner drum and extending within the inner chamber from the object intake to the object outlet, the agitator configured to selectively receive the shaft such that the agitator rotates with the shaft.

8. The apparatus of claim 1, wherein the agitator comprises a brush, the brush comprising a plurality of bristles disposed along a length of the brush.

9. The apparatus of claim 1, wherein the inner drum and the outer drum are substantially cylindrical such that there are no corners where debris can accumulate within the apparatus.

10. The apparatus of claim 1, wherein the outer drum comprises a gas outlet configured for drawing gas from the apparatus, the gas outlet disposed tangential to the outer drum and axially opposite of the object intake, the object intake disposed tangentially to the inner drum.

11. The apparatus of claim 10, wherein a cyclonic gas flow is generated within the apparatus from the object intake to the gas outlet in response to drawing gas from the apparatus through the gas outlet.

12. The apparatus of claim 11, wherein the agitator is configured to rotate in a rotational direction of the cyclonic flow to increase the cyclonic effect of the cyclonic gas flow.

13. A system comprising:

a base unit comprising a pair of elongated rods;

a rotary drive unit coupled to the base unit; and an apparatus comprising:

an inner drum positioned on a first axis and forming an inner chamber interior to the inner drum, the inner drum comprising an object intake coupled to the inner drum at a proximal end of the inner drum and an object outlet disposed at a distal end of the inner drum;

an agitator configured to polish objects within the inner drum as the objects move from the object intake to the object outlet, the agitator disposed within the inner drum on the first axis coaxially with the inner drum, the agitator removably coupled to a rotation element disposed on an end of the inner drum such that the agitator rotates in response to the rotation element being driven by the rotary drive; and an outer drum disposed around the inner drum, the inner drum removably coupled to the outer drum, the outer drum releasably couplable to a base unit using attachment means that correspond to the elongated rods, the base unit comprising the rotation element.

14. The system of claim 13, further comprising a movement device disposed within the inner drum and configured to move the objects within the inner drum from the object intake to the object outlet while the agitator rotates, the movement device removably coupled to the inner drum, the movement device comprising a helical coil.

15. The system of claim 14, wherein the inner drum, outer drum, agitator and the helical coil are separable to facilitate cleaning.

16. The system of claim 13, further comprising a first end cap disposed on a proximal end of the outer drum and a second end cap disposed on a distal end of the outer drum, the first and second end caps removably coupled to the outer drum and configured to create a dust-proof seal within the outer drum.

17. The system of claim 16, wherein the inner drum, the outer drum, the agitator, the first end cap and the second end cap form a replaceable polisher drum assembly replaceable as a unit with another replaceable polisher drum assembly.

18. The system of claim 13, wherein the rotation element comprises a shaft that is selectively disposed on the first axis coaxially with the inner drum and extending within the inner chamber from the object intake to the object outlet, the agitator configured to selectively receive the shaft such that the agitator rotates with the shaft.

19. The system of claim 13, wherein the inner drum and the outer drum are substantially cylindrical such that there are no corners where debris can accumulate within the apparatus.

20. A modular system to polish objects comprising:

a base unit comprising a pair of elongated rods;

a rotary drive unit coupled to the base unit;

an apparatus comprising:

an inner drum positioned on a first axis and forming an inner chamber interior to the inner drum, the inner drum comprising an object intake coupled to the inner drum at a proximal end of the inner drum and an object outlet disposed at a distal end of the inner drum;

an agitator configured to polish objects within the inner drum as the objects move from the object intake to the object outlet, the agitator disposed within the inner drum on the first axis coaxially with the inner drum, the agitator removably coupled to a rotation element disposed on an end of the inner drum and operably coupled to the rotary drive;

an outer drum disposed around the inner drum, the inner drum removably coupled to the outer drum, the outer drum releasably couplable to a base unit using attachment means and the elongated rods, the base unit comprising the rotation element;

a movement device disposed within the inner drum and configured to move the objects within the inner drum from the object intake to the object outlet while the agitator rotates, the movement device removably coupled to the inner drum, the movement device comprising a helical coil;

a vacuum device removably coupled to a gas outlet disposed on a distal end of the outer drum using a vacuum line, the vacuum configured to draw gas from the apparatus through the gas outlet;

a feed chute that is coupled to the base unit and selectively disposed above the object intake of the inner drum to direct objects into the inner drum; and an external gas supply that is removably coupled to the base unit to provide pressurized gas to the apparatus.

* * * * *